US005691601A

United States Patent [19]

Frey et al.

[11] Patent Number: 5,691,601

[45] Date of Patent: Nov. 25, 1997

[54] METAL-HALIDE DISCHARGE LAMP FOR PHOTOOPTICAL PURPOSES

[75] Inventors: Anna-Maria Frey, Munich; Jürgen Maier, Berlin; Manfred Pilsak, Munich; Ralf Seedorf, Berlin; Clemens Barthelmes, Berlin; Thomas Dittrich, Berlin, all of Germany

[73] Assignee: Patent-Treuhand-Gesellschaft F. Elektrische Gluehlampen mbH, Munich, Germany

[21] Appl. No.: 557,145

[22] PCT Filed: Jun. 30, 1994

[86] PCT No.: PCT/DE94/00752

§ 371 Date: Dec. 14, 1995

§ 102(e) Date: Dec. 14, 1995

[87] PCT Pub. No.: WO95/05674

PCT Pub. Date: Feb. 23, 1995

[30] Foreign Application Priority Data

Aug. 16, 1993 [DE] Germany ..... 43 27 534.6

[51] Int. Cl.[6] ..... H01J 61/12

[52] U.S. Cl. ..... 313/571; 313/620; 313/637; 313/641; 313/638; 313/639

[58] Field of Search ..... 313/570, 571, 313/637, 638, 639, 640, 641, 642, 643, 620

[56] References Cited

U.S. PATENT DOCUMENTS

| | | | |
|---|---|---|---|
| 3,586,898 | 6/1971 | Speros et al. . | |
| 3,771,009 | 11/1973 | Silver et al. | 313/641 |
| 3,906,274 | 9/1975 | Silver et al. | 313/641 |
| 3,914,636 | 10/1975 | Sugiura et al. . | |
| 4,591,759 | 5/1986 | Chalek et al. . | |
| 4,672,267 | 6/1987 | Lapatovich et al. . | |

FOREIGN PATENT DOCUMENTS

| | | |
|---|---|---|
| 0 459 786 A3 | 12/1991 | European Pat. Off. . |
| 55-050 567 A | 3/1980 | Japan . |
| 2 237 927 | 5/1991 | United Kingdom . |

*Primary Examiner*—Nimeshkumar Patel

*Attorney, Agent, or Firm*—Frishauf, Holtz, Goodman, Langer & Chick, P.C.

[57] ABSTRACT

A metal-halide discharge lamp for photooptical purposes has a small electrode spacing of less than 15 mm, preferably 2–8 mm, to provide an essentially pin-point light source, and a fill which contains $AlI_3$ in an amount between 0.1 and 4.5 mg/cm$^3$. Other filling components may in particular be halides of mercury, indium, thallium or cesium; up to 2 mg/cm$^3$ of AlBr may be added. The lamp is particularly adapted for combination with a, preferably parabolic, reflector.

20 Claims, 9 Drawing Sheets

METAL-HALIDE DISCHARGE LAMP FOR PHOTOOPTICAL PURPOSES

FIELD OF THE INVENTION

Figure 1:
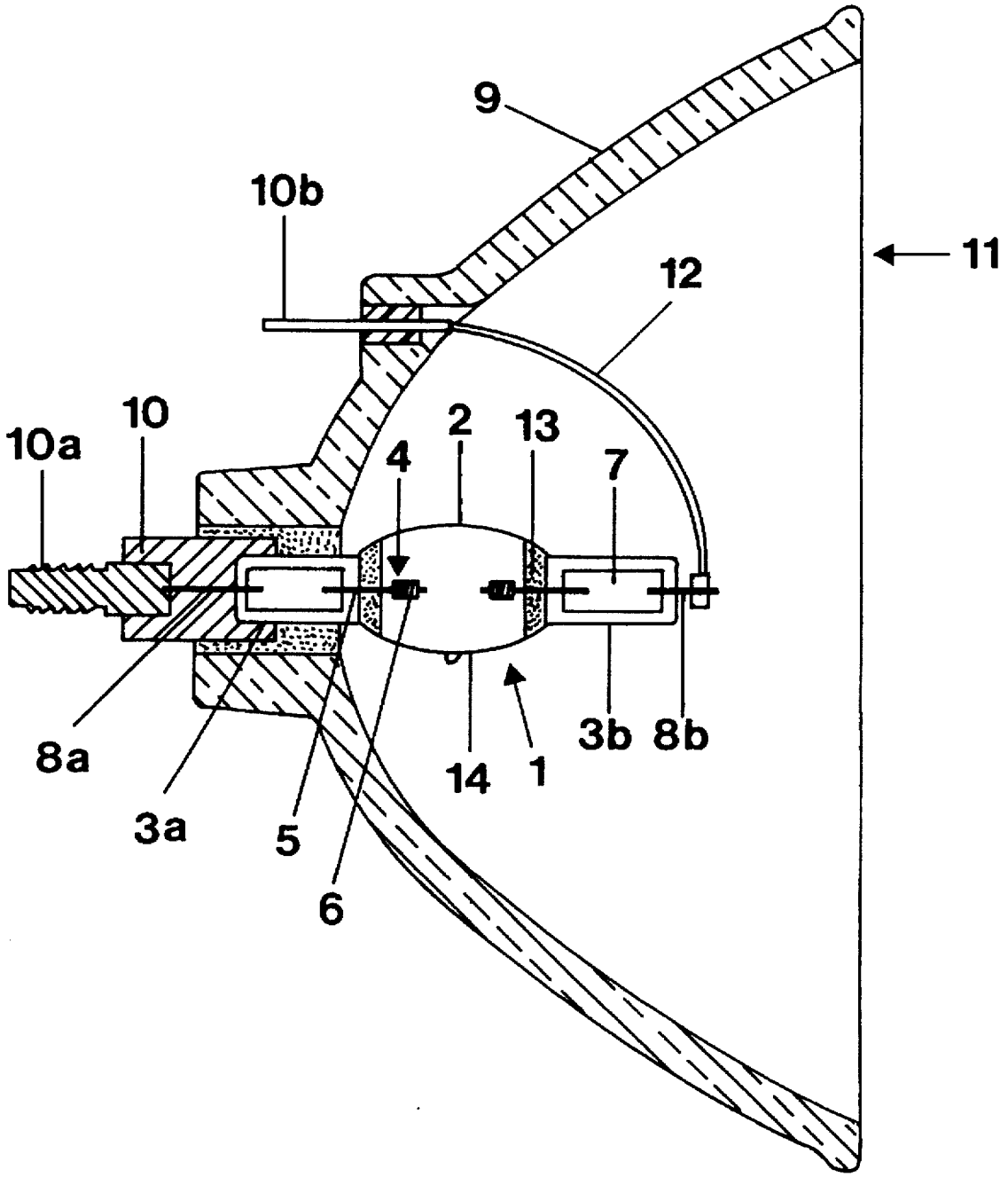

The invention is based on a metal-halide discharge lamp which can be used for instance for video projection, endoscopy, or medical practice (operating room lights), and which is especially suitable for video projection by the liquid crystal technique (LCD), and especially also for large television screens with an aspect ratio of 16 to 9. Typical power ratings are from 100 to 500 W.

BACKGROUND

The use of aluminum in the discharge vessel of lamps has already been known for a long time. However, it is problematic, in view of the hygroscopic performance of the aluminum compound in the filling process and the severe attack on the electrodes during the service life, which greatly limits the service life. Accordingly, the use of fillings that contain aluminum has until now been limited to either electrodeless lamps (U.S. Pat. Nos. 4,672,267 or 4,591,759, for example) or lamps in which the electrodes are especially coated in order to attain a suitable chemical reaction of the aluminum, see U.S. Pat. No. 3,914,636, to which German Patent Disclosure DE-OS 24 22 576 corresponds.

A metal-halide lamp with wall loading of more than 40 W/cm$^2$ is known, in which a filling that contains either aluminum chloride or aluminum bromide is introduced into a discharge vessel that has activated electrodes, see German Patent 1,539,516. However, such fillings tend to make for very short service lives, on the order of magnitude of 100 hours. They are intended to generate a daylight-like spectrum, at the cost of high loading.

U.S. Pat. No. 5,220,237, Maseki et al., to which European Patent Disclosure EP-A 459 786 corresponds, describes a lamp for photooptical purposes with a long service life, particularly for video projection, which as filling components contains in addition to mercury and argon iodides of the rare earths dysprosium and neodymium and of cesium. Rare earth fillings were previously the only ones that were usual for such lamps, because they assure good color rendition with a high light yield. This patent disclosure is hereby expressly incorporated by reference.

Although for general lighting rare earth fillings are quite suitable, they do not meet the high demands made of lighting for photooptical purposes. The reason for this is that large quantities of rare earth metals attack the discharge vessel, which is typically of quartz glass, and at the high operating temperatures this gradually leads to devitrification and finally to the risk of bursting. The devitrification worsens the optical characteristics of such lamps so considerably (diffuse projection of the arc) that the lamps can no longer be used for photooptical purposes, where exact projection of the arc by the optical system is critical. Finally, maintenance of these lamps is also unsatisfactory. The light formation with rare earth metals also results primarily from molecular electron transitions which thus occur at the edge of the arc, so that in the application for projection purposes, for instance, color fringes can appear on the projection screen (poor color uniformity).

THE INVENTION

It is an object of the present invention to create a lamp for photooptical purposes that is distinguished especially by a long service life, good maintenance, and homogeneous color distribution, and which has good color rendition.

Briefly, in accordance with the invention, metal-halide lamps for photo-optical purposes provide a color temperature of 5000 K and have the combination of these features: an electrode spacing of 15 mm at most; to create the most pinpoint possible light source, preferred values are between 2 and 8 mm. The color temperature is above 5000 K, and in particular is from 6000 to 10,000 K; and The lamp was a filling that, as its essential or sole metal-halide component, contains from 0.1 to 4.5 mg/cm$^3$ of $AlI_3$. Adding aluminum in this form to the lamp with the aforementioned small electrode spacing has two advantages. First, accurate metering of even small quantities of aluminum is possible, since the atomic weight of the partner in the compound, iodine, is very high. Second, iodine specifically is especially well-suited for the halogen cycle in this particular case, and it does not attack the electrodes as severely as chlorine or bromine. Another advantage is that this filling system is so nonvulnerable that the same filling can be used for various wattage stages, without changing the color temperature. Finally, the influence of the iodine on the lamp spectrum (absorption in blue) is desired.

Depending on the electrode configuration, it may also be advantageous to add up to 2.0 mg/cm$^3$ of $AlBr_3$.

Until now, $AlI_3$ was not considered to be very suitable, because the light yield obtainable with it is relatively low (approximately 70 lm/W), compared with conventional rare earth fillings (approximately 100 lm/W). However, this failed to take into account the fact that the light yield, referred to the total optical structure, or in other words measured in an associated reflector and with the greatest possible parallelism of the light beam (angle of divergence<5°), becomes substantially better compared with conventional systems, and thus the overall system yield is comparable. This is because light formation takes place by means of atom transitions, which occur predominantly in the short arc core, thus considerably limiting the color separation.

An especially important advantage is finally that the color rendition attainable with $AlI_3$ is an especially good match for the profile demanded. For video projection, what is known as the R/G/B distribution is an especially important parameter for determining color rendition. This is understood to mean the relative distribution of intensity in three selected wavelength ranges, namely red (R), green (G) and blue (B). These ranges will be defined herein as follows:

R=600 nm to 650 nm

G=500 nm to 540 nm

B=400 nm to 500 nm.

Conventional fillings have an excessively high proportion in the green range (and to a lesser extent of the blue range), at the expense of the proportion of red; for instance, R/G/B=18:67:15.

With aluminum iodide as the basic component, because of the uniformity of its spectrum, R/G/B values can be attained that have a markedly higher proportion of red:

R=25% to 35%.

G=50% to 65%

B=8% to 18%.

As further filling additives for fine tuning, InI (or some other halide of indium) and possibly a halide of mercury (such as $HgI_2$, $HgBr_2$) in a total amount of up to 2.0 mg/cm$^3$, and preferably up to 1.0 mg/cm$^3$, are especially suitable. By means of halides of indium, the proportion of blue can be finely tuned, for instance. Other suitable filling additives (up to 1.0 mg/cm$^3$) are halides of thalium and/or cesium, for fine tuning of the proportion of green and for arc stabilization. Finally, a slight addition of rare earth metals, preferably in metallic form, for filling up the spectrum especially between about 500 and 600 nm is possible, in an amount up to 0.5 mg/cm$^3$. Thulium and dysprosium, especially in an amount up to 0.1 mg/cm$^3$, are preferred. This amount is so slight that the resultant devitrification is insignificant.

Preferred halides are in general iodine and/or bromine; a mixture that is adapted in terms of geometry and volume inhibits electrode consumption.

One special advantage is that the electrodes in the present filling require no special treatment whatever; that is, no coating (for instance with scandium oxide or thorium oxide as known in the art) is necessary. Electrodes in which a coil is slipped onto a shaft, where the shaft material is of tungsten doped with a material of lower electron affinity (such as $ThO_2$), while the coil is advantageously of updoped tungsten, are especially suitable.

For the bulb, quartz glass is suitable, especially a bulb pinched at both ends, which is covered on one or both ends for instance with a heat coating (such as $ZrO_2$). Under some circumstances, the homogeneity of the light and color distribution can be improved, as known per se, by being made matte.

In principle, a bulb of ceramic material ($Al_2O_3$), as already known for other lamp types, is also suitable. Advantageously, the lamp is put together with a reflector to make a structural unit, as described in U.S. Pat. No. 5,220,237 (European Patent Disclosure EP-A 459 786). The lamp is then mounted approximately axially in the reflector. The reflector is coated dichroitically, for instance.

The lamp is especially well-suited to projection technology based on liquid crystals, which is also suitable as the basis for high-definition television (HDTV). This technology requires lighting medium in the form of a discharge lamp with special properties, especially in terms of the optimal balance of the R/G/B proportions, the usable light flux of the screen, and the light density. Other characteristics are service lives longer than 2000 hours, high maintenance (above 50%, as much as possible) with respect to the color location and intensity, and the most parallel possible light emission. High light density and maintenance of the color location and of the intensity is necessary because the optical system efficiency in the final analysis is on the order of only 1 to 2%. Since the angular acceptance of liquid crystals (LCDs) is at a maximum of only 5°, extremely parallel light is necessary, which is the same thing as saying that the demand is for the most pinpoint possible light source. In general, however, this shortens the service life of the lamp. Other substantial demands are for homogeneity of the color temperature and of the distribution of lighting intensity on the projection screen.

A filling system having up to 4.5 mg/cm$^3$ of $AlI_3$ and up to 2.0 mg/cm$^3$ of InI is especially suitable. Both components produce light by atom transitions, so that color fringes are avoided here as well. One general advantage of the filling is that the color proportions and their ratios vary only slightly over the service life.

In an especially preferred version, the lamp comprises a discharge vessel of quartz glass, pinched on both ends, with axially arranged tungsten electrodes. This discharge vessel is installed in a paraboloid reflector with dichroitic coating; the diameter of the reflector is adapted to the diagonal of the liquid crystal array (LCD). The coating of the reflector is equivalent to an optical band pass that reflects the visible spectrum and transmits IR and UV components. Increased uniformity in the distribution of color and intensity in the LCD plane can be attained by suitable matting of the discharge vessel. Often, a heat buildup coating is applied to one or both the vessel ends surrounding the electrodes. The lamp is operated with an electronic ballast device, known per se, which also assures reignition while hot.

Figure 2:
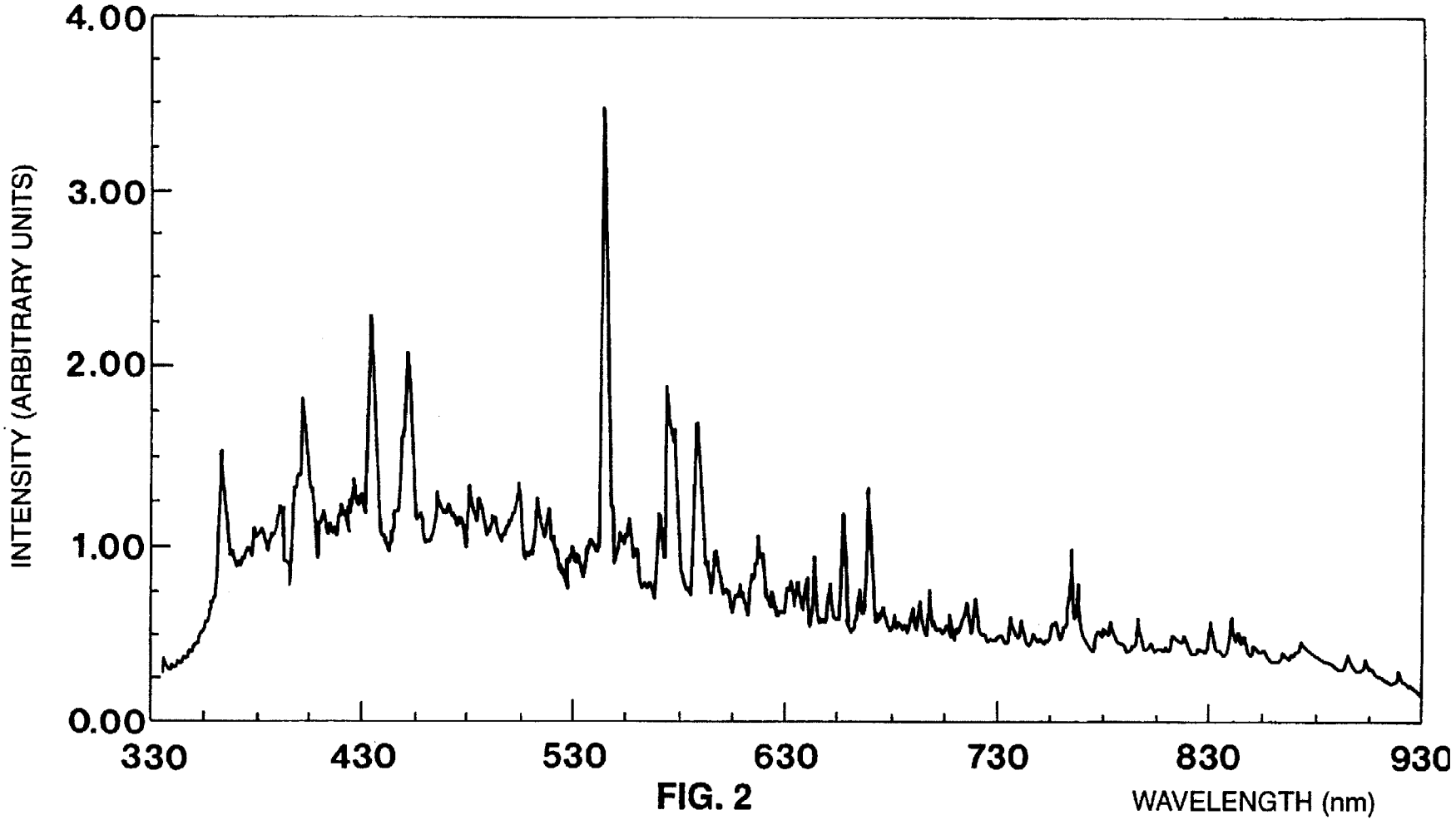

DRAWINGS:

Several exemplary embodiments will be described in further detail below in conjunction with the drawings. Shown are:

FIG. 1, a schematic illustration of the lamp with a reflector;

FIG. 2, the spectrum of a lamp;

FIGS. 3–8, measurement findings with respect to the light flux, the color temperature, and the color location for various fillings.

FIG. 1 shows a metal-halide lamp 1 with a power of 170 W and a discharge vessel 2 of quartz glass, which is pinched on both ends at 3*a*, 3*b*, hereinafter, collectively 3. The discharge volume is 0.7 cm$^3$. The electrodes 4, axially opposite one another, are spaced apart by a distance of 5 mm. They comprise an electrode shaft 5 of thoriated tungsten, over which a coil 6 of tungsten is slipped. The shaft 5 is connected, in the region of the pinched end 3, to an external power lead 8 via a foil 7.

The lamp 1 is located approximately axially in a parabolic reflector 9, and the arc that develops in operation between the two electrodes 4 is located at the focal point of the paraboloid. Part of the first pinched end 3*a* is located directly in a central bore of the reflector, where it is retained in a base 10 by means of cement; the first power lead 8*a* is connected to a screw-type base contact 10*a*.

The second pinched end 3*b* is oriented toward the reflector opening 11. The second power lead 8*b* is connected in the region of the opening 11 to a cable 12, which is returned in insulated fashion through the wall of the reflector back to a separate contact 10*b*. The power leads 8*b* are hereinafter collectively referred to as "8". The outer surfaces of the ends 13 of the discharge vessel are coated with $ZrO_2$, for heat buildup purposes. The central portion 14 of the discharge vessel is matted, to improve uniformity.

In a first exemplary embodiment, the filling of the discharge volume, besides 200 mbar of argon and mercury, contains the following:

1.15 mg of $AlI_3$ 0.1 mg of InI 0.36 mg of $HgBr_2$.

The spectrum of this lamp is shown in FIG. 2. With it an R/G/B ratio of 26:58:16 is attained. The wall loading is approximately 35 W/cm$^2$. In the process of filling the lamp with $AlI_3$, care should be taken to assure the best possible purity, and especially to assure the absence of oxygen.

In a second exemplary embodiment, 1.15 mg of $AlI_3$ is used, and in a third exemplary embodiment 1.15 mg of $AlI_3$ and 0.05 mg of Tm are used. The R/G/B ratio is then 29:55:16 and 28:57.5:14.5, respectively.

Figure 8:
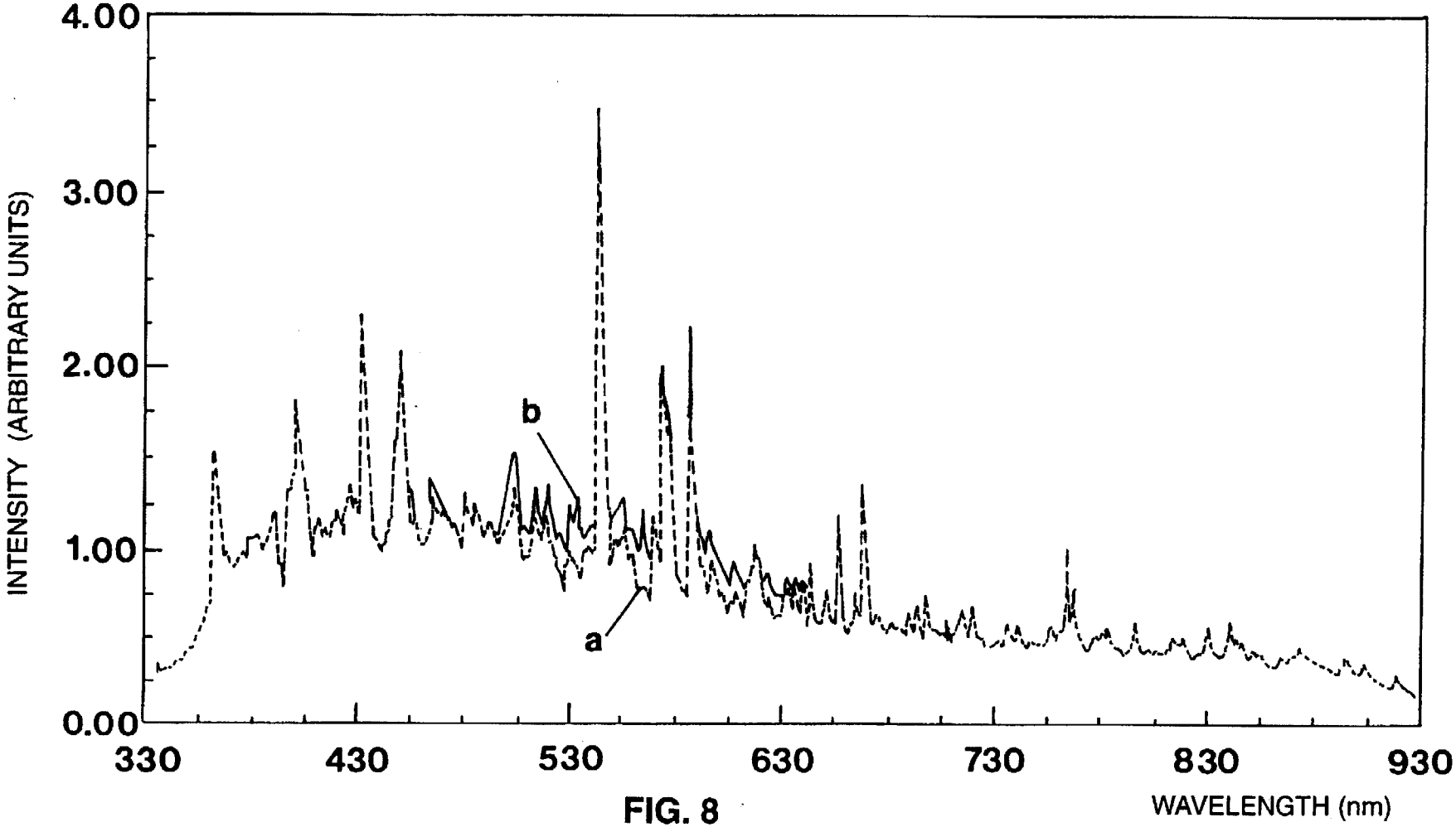

In a fourth exemplary embodiment, 0.05 mg of Tm are added to the first exemplary embodiment. The R/G/B ratio attained is 26.5:57.5:16. The resultant spectrum is shown in FIG. 8. There the spectrum without Tm (curve a) of FIG. 2 is compared with the Tm-containing filling (curve b). The thulium primarily causes a filling up of the spectrum between 510 and 630 nm.

With these fillings, good color uniformity in the projection is attained, as well as excellent constancy of the color temperature $T_n$ over a service life of 2000 hours; the maintenance is 70%. The color location is x=0.295 and y=0.317.

The color temperature $T_n$ can be adjusted by varying the quantity of $AlI_3$, with starting values of $T_n$ of between 6000 and 10,000 K.

Particularly good results in terms of service life and maintenance can be attained with the following fillings:

0.45–3.3 mg/cm$^3$ of $AlI_3$

0–0.3 mg/cm$^3$ of In halide, especially InI

0–0.7 mg/cm$^3$ of Hg halide, especially $HgBr_2$

0–0.7 mg/cm$^3$ of halides of Cs and/or Tl

Figure 3:
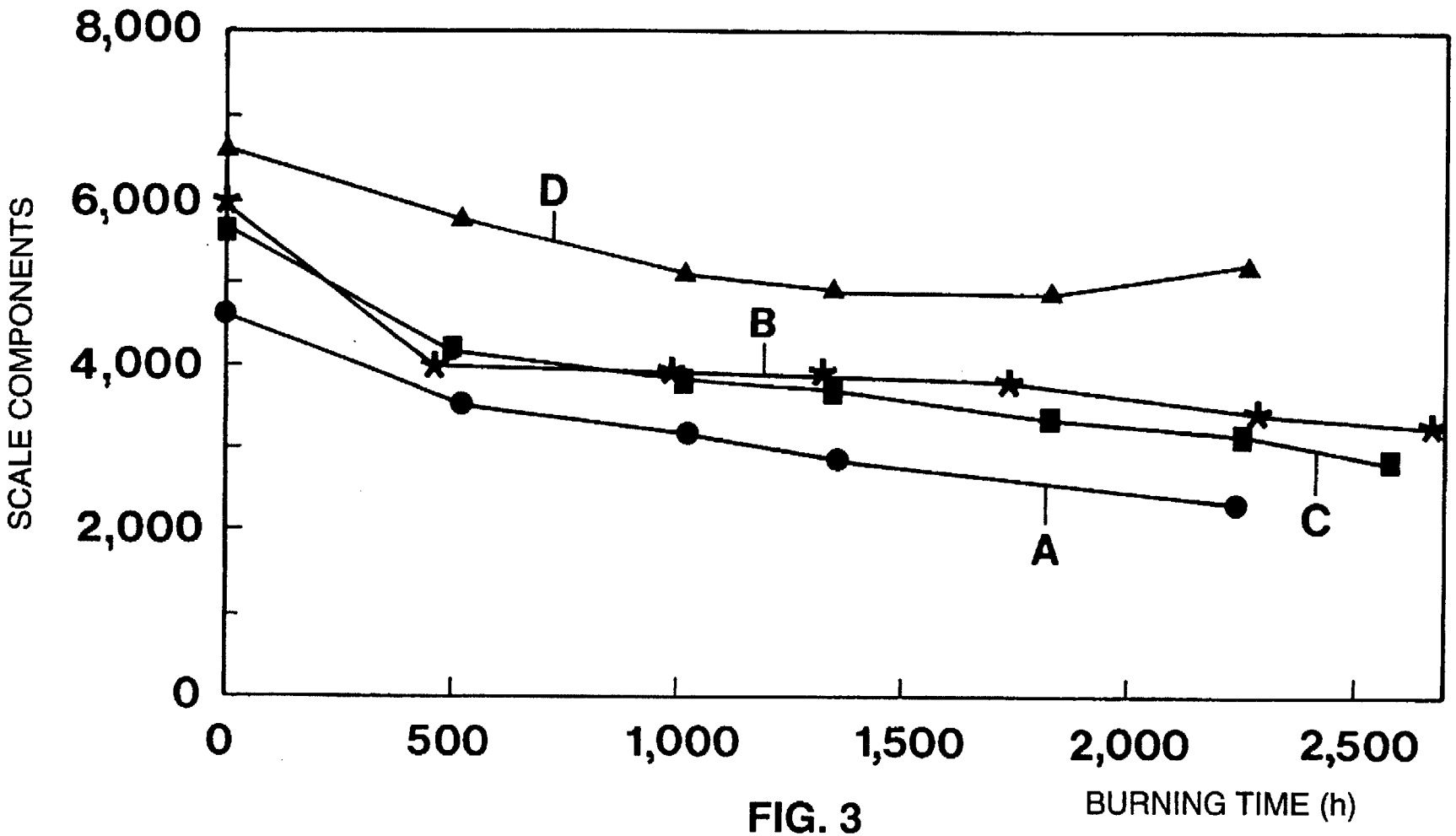
Figure 4:
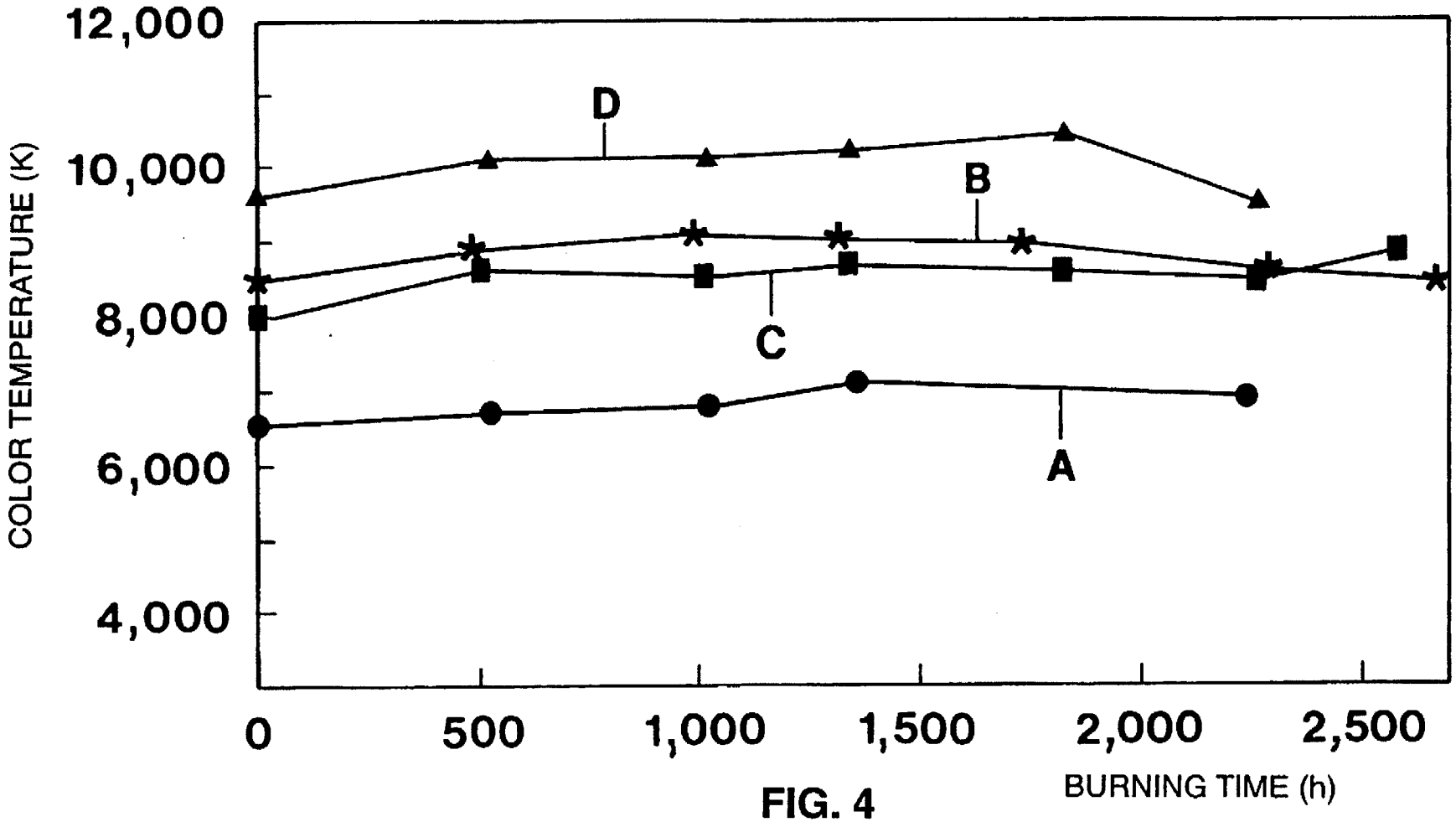

FIGS. 3 and 4 show the maintenance of the light flux within an angle of 5° (so-called panel lumens) in relative units, and the course of the color temperature, in each case over a lamp burning time of more than 2000 h, for various fillings in a 170 W lamp (volume, 0.7 cm$^3$). The discharge vessel was coated with $ZrO_2$, but without matting. The various fillings are:

A) 2.3 mg of $AlI_3$, 0.1 mg of InI, 0.36 mg of $HgBr_2$

B) 1.15 mg of $AlI_3$, 0.1 mg of InI, 0.36 mg of $HgBr_2$

C) 0.6 mg of $AlI_3$, 0.1 mg of InI, 0.36 mg of $HgBr_2$

D) 0.3 mg of $AlI_3$, 0.1 mg of InI, 0.36 mg of $HgBr_2$

It can be seen from FIG. 3 that the maintenance after 2000 hours is on the order of magnitude of 60 to 75%. After 3000 hours, it is still 50 to 65% and thus still meets the minimum requirements. The absolute value of the light flux is the highest with a low dose of Al (D), and it decreases as the dose of Al rises. The dropoff over the course of the burning time is approximately independent of the quantity of aluminum.

In FIG. 4, the color temperature $T_n$ is inversely proportional to the dose of aluminum. It is extremely constant over the burning time. In general, color temperatures of around 8000 K are preferred for video projection, corresponding to a dose of 0.6 to 1.15 mg, which is equivalent to a volume-independent dose of 0.85 to 1.65 mg/cm$^3$.

If both these drawings are studied together a major advantage of these fillings become clear, namely the different demands, for instance with respect to the color temperature, can be met without major changes in the filling, except for the quantity of $AlI_3$, or in other technical properties of the lamp.

Figure 5A:
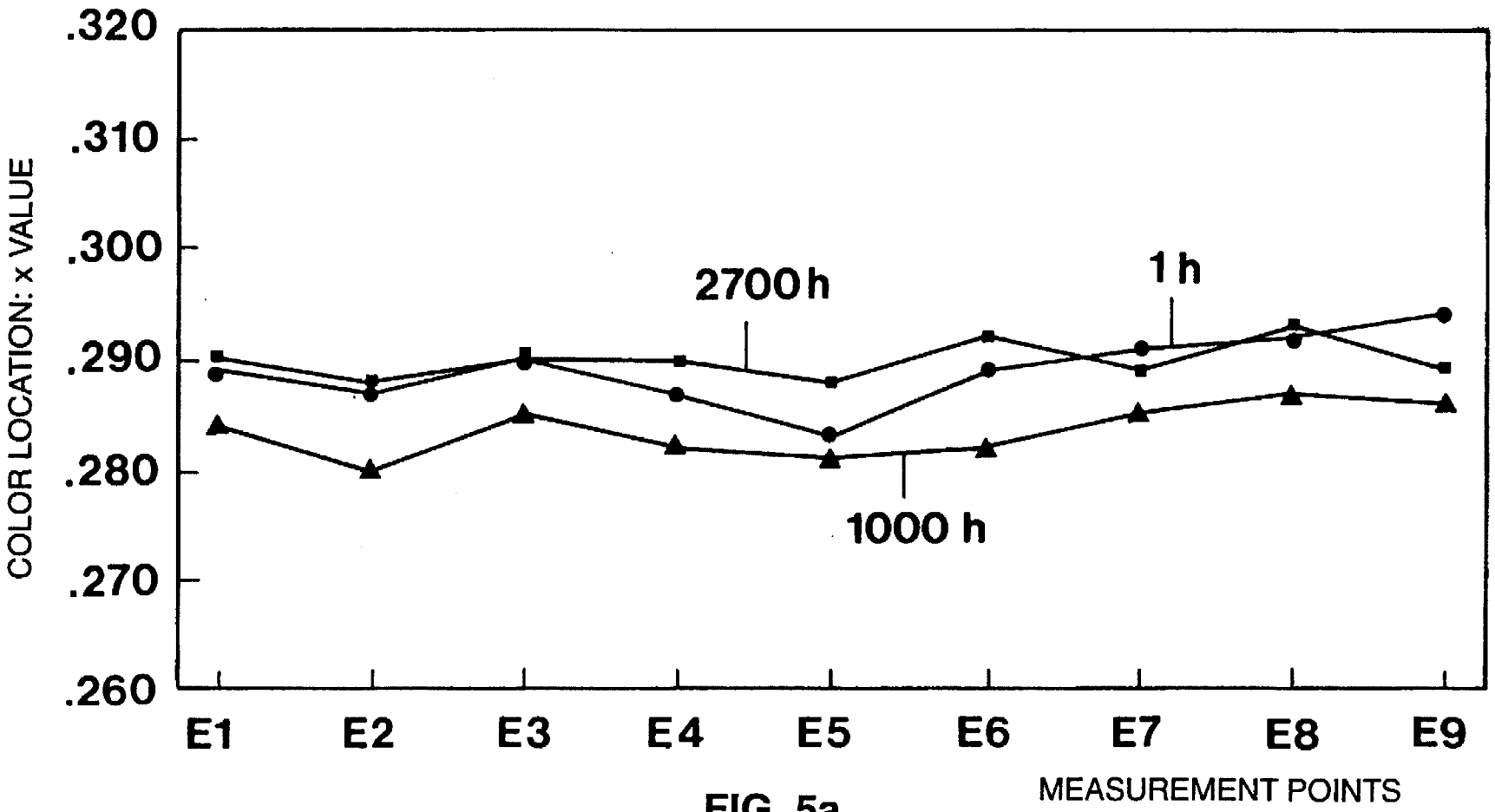
Figure 5B:
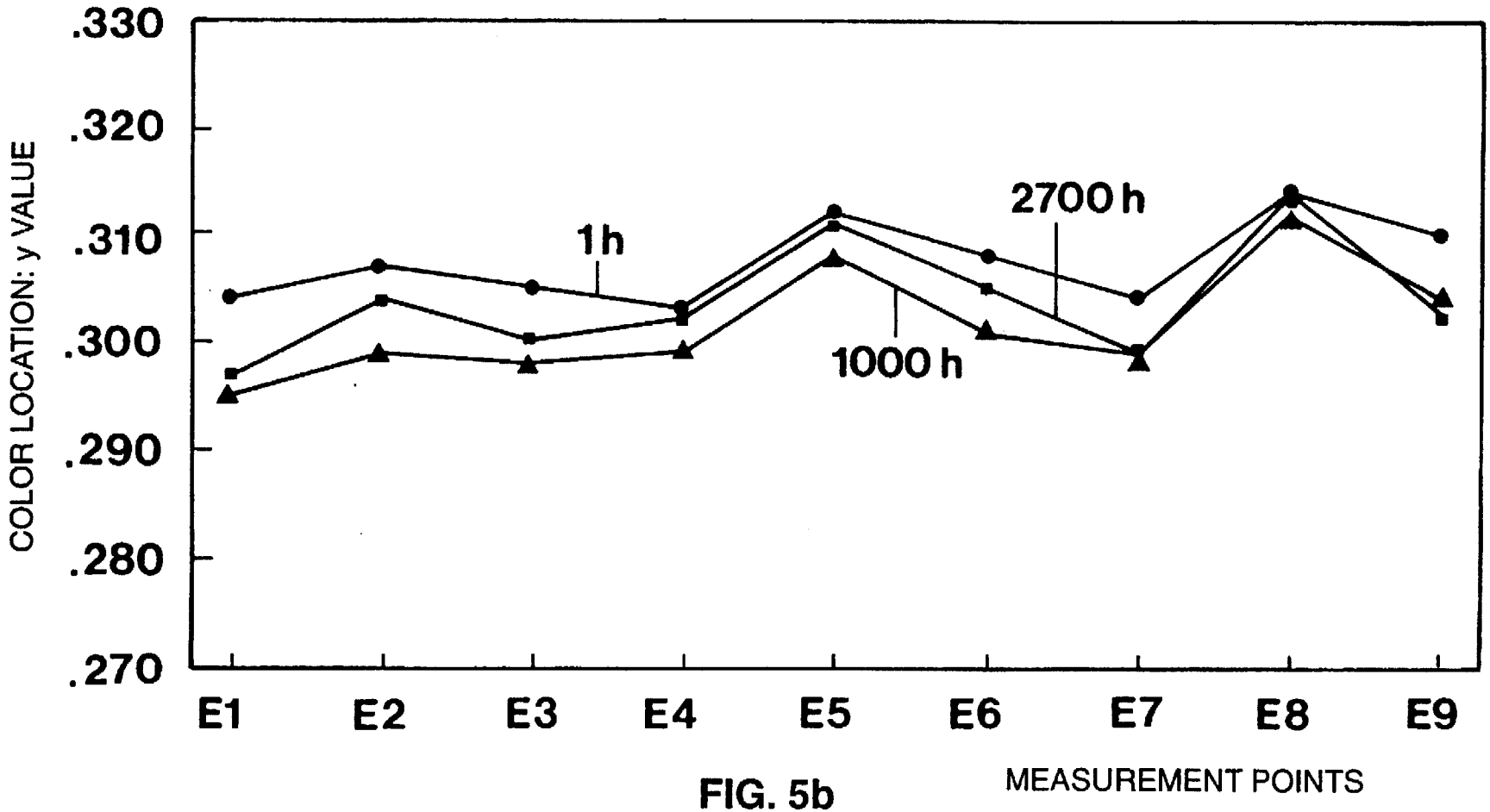

FIG. 5 for filling B) shows the color location (x or y value) as a function of the service life (starting value after 1 hour, value after 1000 and 2700 h) and of the location (nine measuring points E1–E9, which are located uniformly over the area of the projection screen in a 3×3 matrix). The x value fluctuates only slightly between x=0.28 and x=0.29, while the y value fluctuates between y=0.295 and 0.31.

Figure 6:
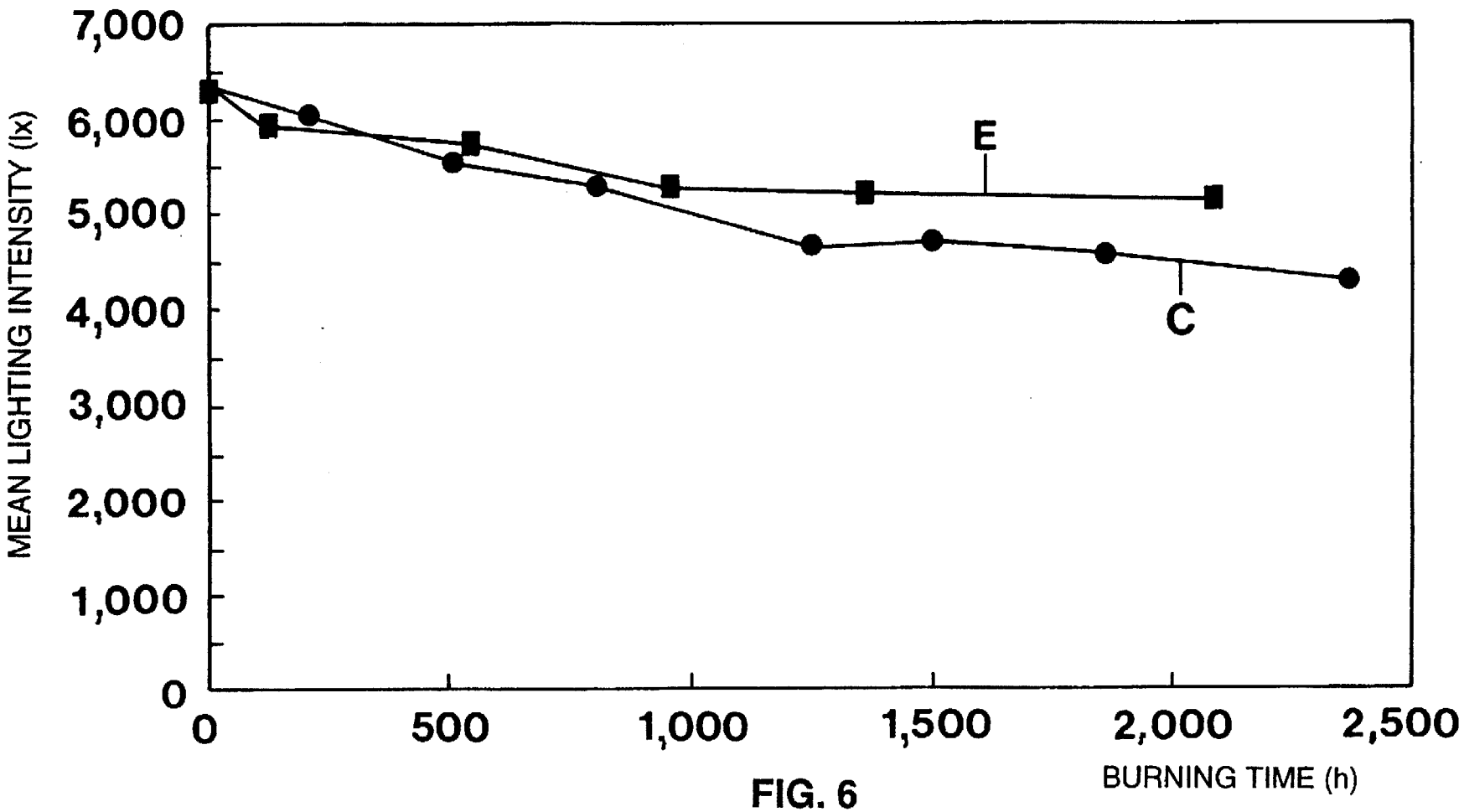
Figure 7:
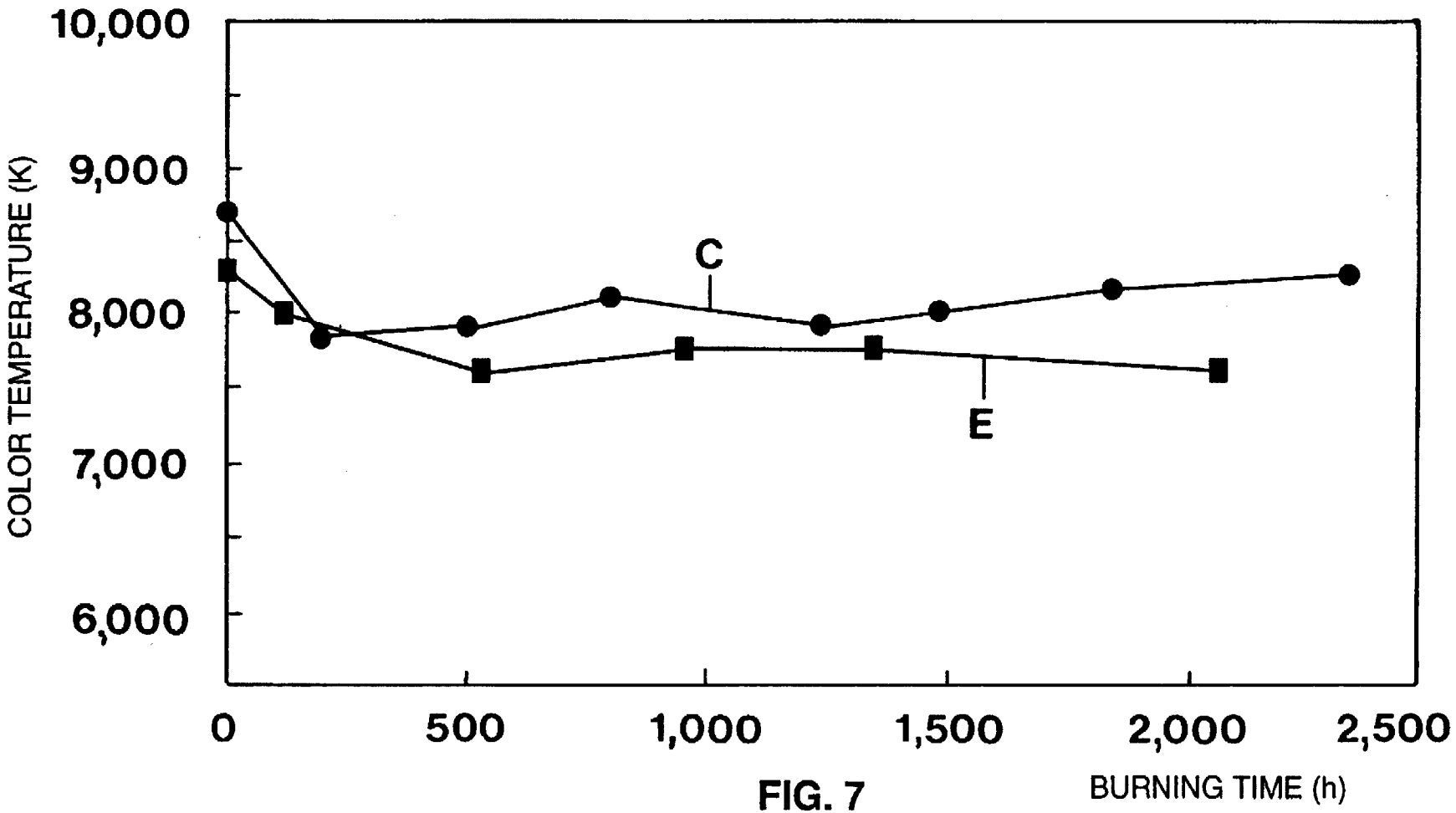

In FIGS. 6 and 7, finally, the performance of a 200 W lamp is shown, which is otherwise similar in design to the 170 W lamp. The fillings used here are in one case identical to filling C); in the other, the following filling E) was used:

E) 0.9 mg of $AlI_3$, 0.1 mg of InI, 0.36 mg of $HgBr_2$.

FIG. 6 shows the lighting intensity on a projection screen in lux, averaged over the grid of nine measuring points described in FIG. 5 as a function of the burning time, while FIG. 7 shows the color temperature as a function of the burning time.

Once again, the nonvulnerability of the filling system based on $AlI_3$ with respect to special adaptations to special demands is confirmed.

In general, the addition of slight quantities of rare earth metals can shorten the service life of the lamps of the invention somewhat. This is compensated for, however, by an increase in the light yield (by up to 10%) and a lowering of the color temperature (by as much as 500 K).

We claim:

1. A metal-halide discharge lamp for photooptical purposes having a translucent discharge vessel (2);

two spaced electrodes (4) which face one another within the vessel and which are connected to power leads (8) extending to the outside, characterized by an arrangement for providing a light source which is close to a pin-point light source and which provides light at a color temperature of at least 5000 K, wherein said arrangement comprises an electrode spacing of a maximum of 15 mm; and a filling within the vessel which comprises 0.1 to 4.5 mg/cm$^3$ of Al $I_3$, as the essential or sole metal-halide component for light generation by said light source; and 0 to 2.0 mg/cm$^3$ of halides (Ha) of indium (InHa) and mercury ($HgHa_2$), or halides ($Ha_2$) of mercury (Hg).

2. The lamp of claim 1, characterized in that the filling additionally contains up to 1.0 mg/cm$^3$ of halides of thallium (TlHa) and cesium ($CsHa_2$), or halides of cesium (CsHa).

3. The lamp of claim 2, characterized in that the electrode spacing is between 2 and 8 mm.

4. The lamp of claim 2, characterized in that the lamp forms a structural unit with an optical reflector (9), optionally an essentially parabolic reflector; and that the electrode spacing is between 2 and 8 mm.

5. The lamp of claim 1, characterized in that the lamp forms a structural unit with an optical reflector (9), optionally an essentially parabolic reflector.

6. The lamp of claim 1, characterized in that the electrodes (4) are made from tungsten, and the electrode or a portion thereof optionally is doped with a material of low electron affinity.

7. The lamp of claim 6, characterized in that the electrodes (4) are uncoated.

8. The lamp of claim 6, characterized in that the lamp forms a structural unit with an optical reflector (9), optionally an essentially parabolic reflector; and that the electrode spacing is between 2 and 8 mm.

9. The lamp of claim 1, characterized in that the electrode spacing is between 2 and 8 mm.

10. The lamp of claim 1, characterized in that the discharge vessel (2) is a quartz glass bulb pinched at both ends, which is optionally coated in its entirety or partially.

11. The lamp of claim 1, characterized in that the lamp forms a structural unit with an optical reflector (9), optionally an essentially parabolic reflector; and that the electrode spacing is between 2 and 8 mm.

12. The lamp of claim 1, characterized in that the filling additionally contains up to 2.0 mg/cm$^3$ of AlBr.

13. The lamp of claim 12, characterized in that the electrode spacing is between 2 and 8 mm.

14. The lamp of claim 12, characterized in that the lamp forms a, structural unit with an optical reflector (9), optionally an essentially parabolic reflector; and that the electrode spacing is between 2 and 8 mm.

15. The lamp of claim 1, characterized in that the filling additionally contains up to 0.5 mg/cm$^3$ of rare earth metals.

16. The lamp of claim 15, characterized in that the electrode spacing is between 2 and 8 mm.

17. The lamp of claim 15, characterized in that the lamp forms a structural unit with an optical reflector (9), optionally an essentially parabolic reflector; and that the electrode spacing is between 2 and 8 mm.

18. The lamp of claim 1, characterized in that over three selected wavelength ranges R/G/B, where R=600 nm to 650 nm G=500 nm to 540 nm B=400 nm to 500 nm, the relative light intensity distribution amounts to R=25% to 35%

G=50% to 65%

B=8% to 18%.

19. The lamp of claim 18, characterized in that the electrode spacing is between 2 and 8 mm.

20. The lamp of claim 18, characterized in that the lamp forms a structural unit with an optical reflector (9), optionally an essentially parabolic reflector; and that the electrode spacing is between 2 and 8 mm.

* * * * *